United States Patent [19]

Svenson

[11] Patent Number: 4,520,869

[45] Date of Patent: Jun. 4, 1985

[54] CENTRALIZER FOR WELL CASINGS

[76] Inventor: Bert N. Svenson, 9259 Raviller Driver, Downey, Calif. 90240

[21] Appl. No.: 537,096

[22] Filed: Sep. 29, 1983

[51] Int. Cl.[3] ..... G21B 17/10

[52] U.S. Cl. ..... 166/241; 166/172

[58] Field of Search ..... 166/241, 138, 172, 210, 166/173; 175/325

[56] References Cited

U.S. PATENT DOCUMENTS

| | | | |
|---|---|---|---|
| 1,623,866 | 4/1927 | Egennott | 166/241 X |
| 2,680,488 | 6/1954 | Atkinson | 166/4 |
| 2,738,019 | 3/1956 | Atkinson | 166/241 |
| 3,055,432 | 9/1962 | Park | 166/241 |
| 3,356,147 | 12/1967 | Dreyfuss | 166/241 |
| 4,011,907 | 3/1977 | Clay | 166/241 |
| 4,042,022 | 8/1977 | Wills et al. | 166/241 |
| 4,077,470 | 3/1978 | Dane | 166/244 R |
| 4,088,186 | 5/1978 | Callihan | 166/241 |
| 4,143,713 | 3/1979 | Kreft | 166/241 |
| 4,219,081 | 8/1980 | Howe | 166/241 |
| 4,269,269 | 5/1981 | Wilson | 166/241 |
| 4,363,360 | 12/1982 | Richey | 166/241 |

*Primary Examiner*—Stephen J. Novosad
*Assistant Examiner*—Thuy M. Bui
*Attorney, Agent, or Firm*—Harris, Kern, Wallen & Tinsley

[57] ABSTRACT

A centralizer for a well casing, and the method of producing a centralizer, for assembly in the field. The centralizer comprises two collars and a plurality of spring bows, with a bow receiving section in each collar for each bow. Aligned channels are formed in the collar defining a passage for receiving a bow end, and each bow end has a hat section for positioning in the aligned channels. After a bow end is inserted in a collar passage, one of the channels is compressed into the bow hat section to lock the bow in place.

24 Claims, 17 Drawing Figures

CENTRALIZER FOR WELL CASINGS

BACKGROUND OF THE INVENTION

This invention relates to centralizers for well casings and in particular, to a new and improved centralizer and method of producing same suitable for shipping unassembled, and subsequent assembly in the field.

Centralizers are used on casings in wells for maintaining the casing substantially centered in the bore, particularly when there are curves in the bore. Such centralizers have been in use for many years, and consist of two collars for positioning around the well casing, typically at a joint, with the collars joined by plurality of spring bows. In the conventional centralizer, the bows are fixed to the collars, typically by welding. The resulting centralizer is relatively large and therefore requires considerable space for storage and shipping. Therefore various efforts have been made to design a satisfactory centralizer which can be stored and shipped unassembled, and be assembled in the field at the well site by use of simple hand tools such as a hammer. A variety of prior art designs are known, including those shown in the following U.S. Pat. Nos. 2,680,488; 2,738,019; 3,055,432; 3,356,147; 4,011,907; 4,042,022; 4,077,470; 4,088,186; 4,143,713; 4,219,081; 4,269,269; and 4,363,360.

Among the problems encountered in the prior art designs are the difficulty of assembly in the field by unskilled workers working under adverse conditions, and the strength and durability of the junction formed between the bows and the collars.

Accordingly, it is an object of the present invention to provide a new and improved bore hole centralizer which is easier to assemble and one having improved strength and life. A further object of the invention is to provide a new and improved method of producing a bore hole centralizer and especially a method with a simpler final assembly step.

Other objects, advantages, features and results will more fully appear in the course of the following description.

SUMMARY OF THE INVENTION

The preferred embodiment of the centralizer includes a pair of collars and a plurality of bows for positioning between the collars. Each collar has a bow receiving section for each bow, with each section having first and second aligned channels formed in one direction and a third channel formed in the opposite direction with the three channels defining a bow receiving passage. Each of the bows has a collar engaging section at each end formed with a hat section with an upstanding third member between first and second aligned members. A bow end is slideable to a collar passage with a bow hat section third member disposed in the opening between the first and second channels of the collar. At final assembly, the third channel of the collar is compressed or deformed into the hat section of the bow for locking the bow and collar together.

DESCRIPTION OF THE PREFERRED EMBODIMENTS

Figure 1:
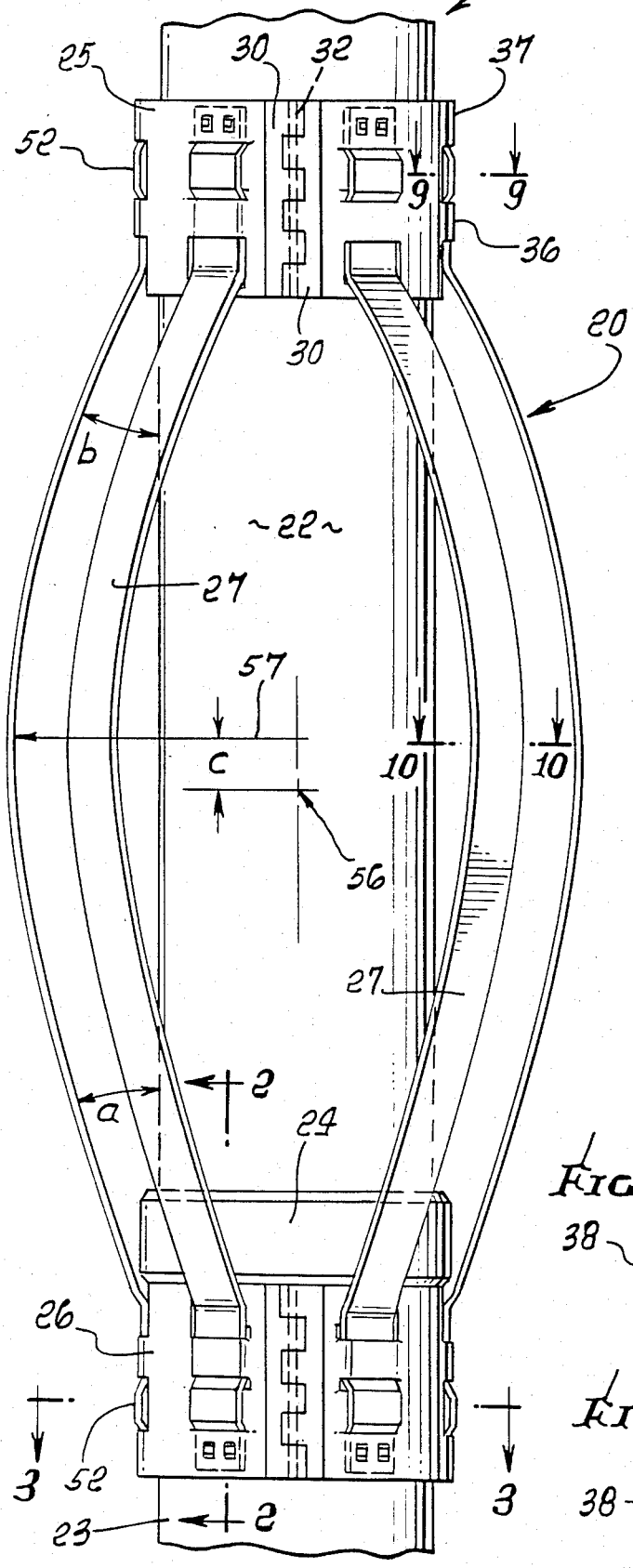
FIG. 1 is a side view of a bore hole centralizer mounted on a well casing and incorporating the presently preferred embodiment of the invention.

In FIG. 1, a bore hole centralizer 20 is mounted on a well casing 21 shown as lengths of pipe 22, 23 joined by a coupling 24. The centralizer 20 is formed of collars 25, 26 interconnected by a plurality of spring bows 27. The collars ordinarily are identical and the bows ordinarily are identical, but variations can be made as desired.

Figure 3:
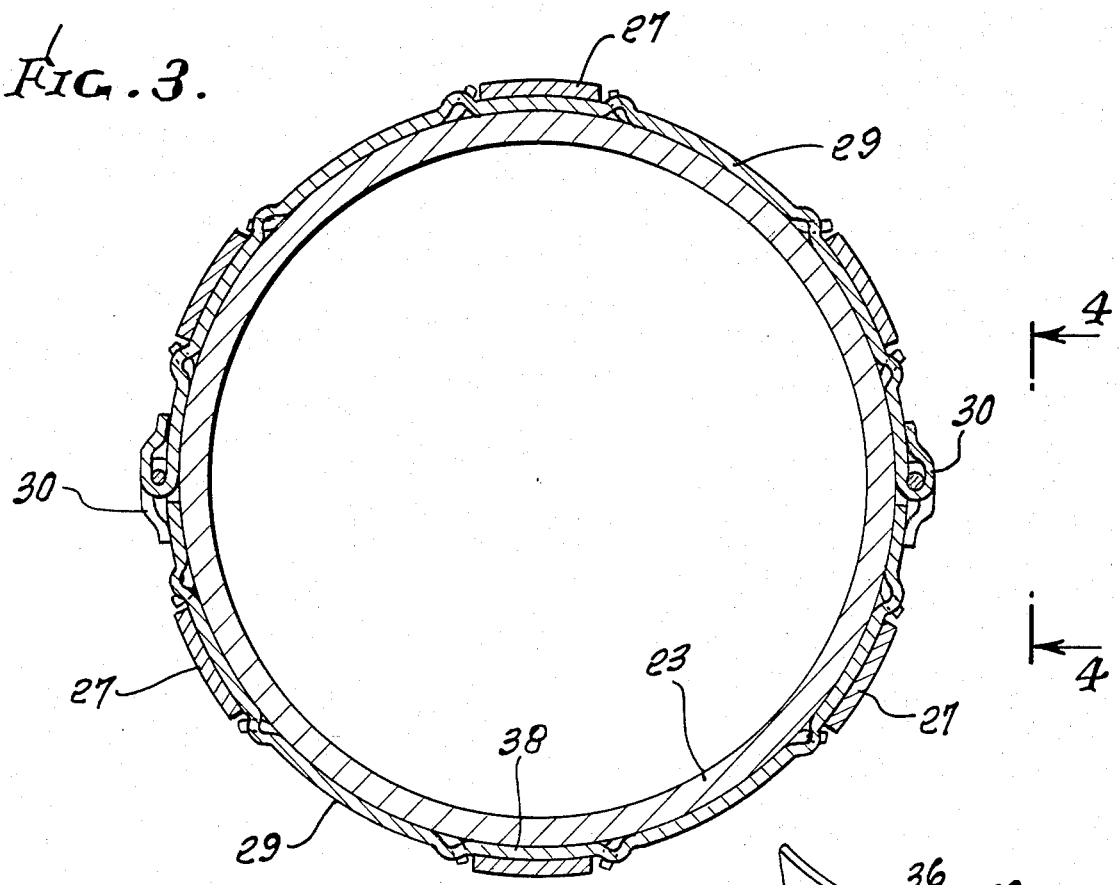
FIG. 3 is an enlarged sectional view taken along the line 3—3 of FIG. 1.
Figure 4:
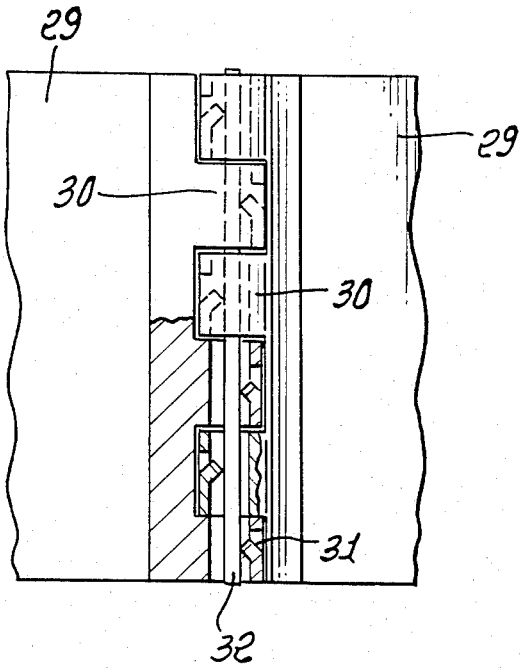
FIG. 4 is a side view, partly in section, taken along the line 4—4 of FIG. 3.

Typically, each collar is formed of a plurality of identical arcuate segments 29, and two such segments are shown in FIG. 3. The collar segments preferably are joined by hinges, for easy assembly in the field, and a preferred hinge construction is shown in FIGS. 3 and 4. In the embodiment illustrated, three interengaging hinge loops 30 are formed at each end of each collar segment 29. Typically the loop is produced by folding a collar end on itself, to provide an open center which preferably is elongated with the longer axis of the loop generally tangent to the collar circle, as best seen in FIG. 3. A tab 31 is formed in each loop, projecting into the open center, preferably at an oblique angle, such as about 45°, as shown in FIG. 4.

The collar segments are joined at the ends by pins 32 to complete the assembly of a collar. The construction illustrated permits the collar to be adapted to use with casings having a variation in outside diameter. The elongate loops at each joint gives a substantial variation in circumference of the assembled collar. At the same time, the tabs 31 produce a snug fit for the pin, eliminating play in the collar segments, and also locking the pin in space.

Figure 12:
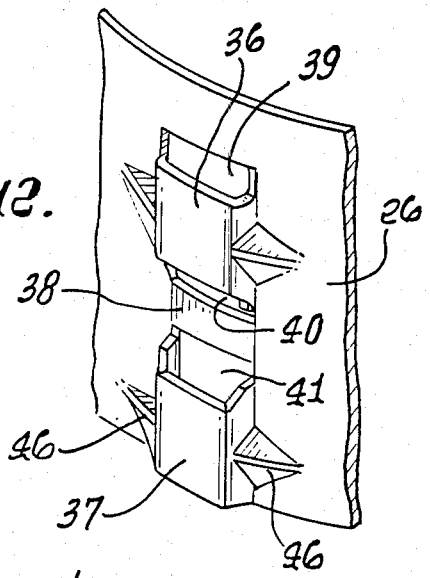
FIG. 12 is an enlarged partial view in perspective showing a portion of the collar and incorporating an alternative embodiment of the invention.
Figure 5:
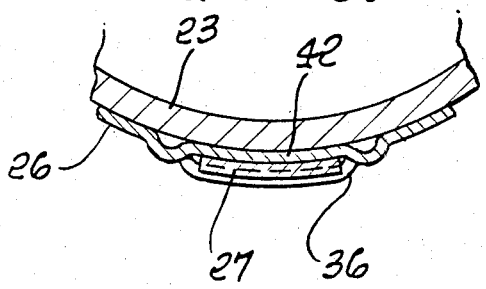
FIG. 5 is a sectional view takely along the line 5—5 of FIG. 2.
Figure 6:
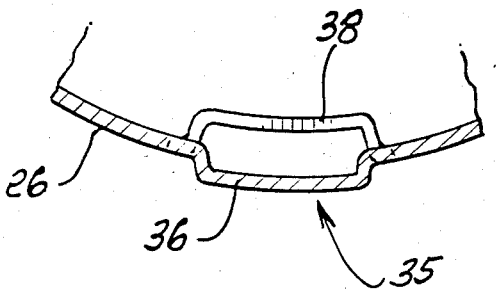
FIGS. 6, 7 and 8 are enlarged partial sectional views similar to that of FIG. 3, showing steps in the assembly of the centralizer.
Figure 6A:
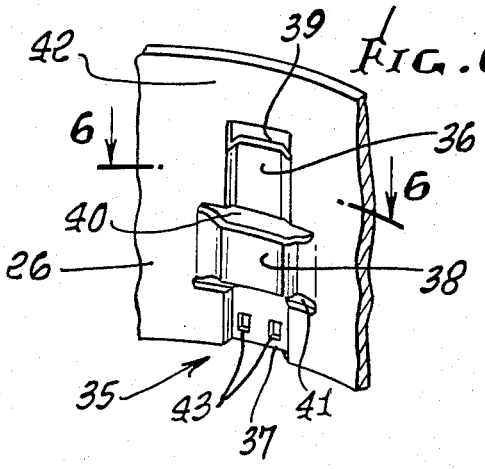
FIGS. 6*a*, 7*a* and 8*a* are perspective views corresponding to FIGS. 6, 7 and 8, respectively, showing steps in the assembly of the centralizer.
Figure 8:
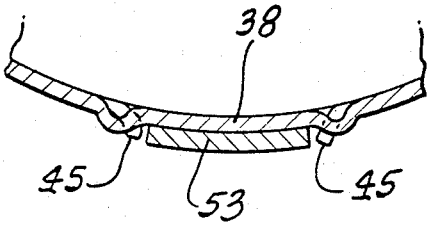
Figure 8A:
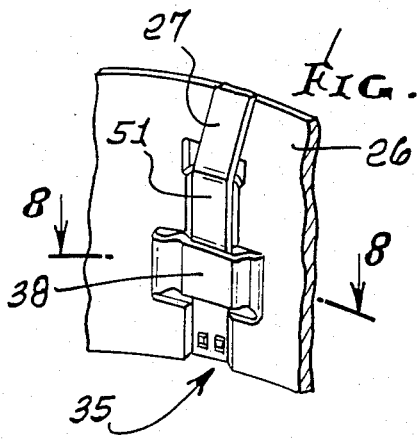

Each collar has a bow receiving section 35 for each bow in the centralizer. In the embodiment illustrated, six bows 27 are carried in two collar segments 29 and hence each collar segment will have three of the bow receiving sections. One such section is shown in detail in FIGS. 6 and 6*a*. A first channel 36 and a second channel 37 are formed in the collar, projecting outward, and a third channel 38 is formed in the collar between the first and second channels, projecting inward. This may be accomplished by first punching slots 39, 40, 41 in the collar and then appropriately bending the collar. In this embodiment illustrated, there is an end section 42 of the collar which does not have channels formed therein. In an alternative embodiment, this end section may be omitted. In the preferred embodiment, two openings 43 are punched in the second channel 37. Also, in the preferred embodiment, tabs 45 are formed at the ends of the slots 40, 41, with the tabs bent in an outward direction, as best seen in FIG. 8. If desired, reinforcing ribs 46 for the channels 36, 37 may be provided in the collars, as by pressing a wedge shaped rib in the collar, best seen in FIG. 12.

Figure 2:
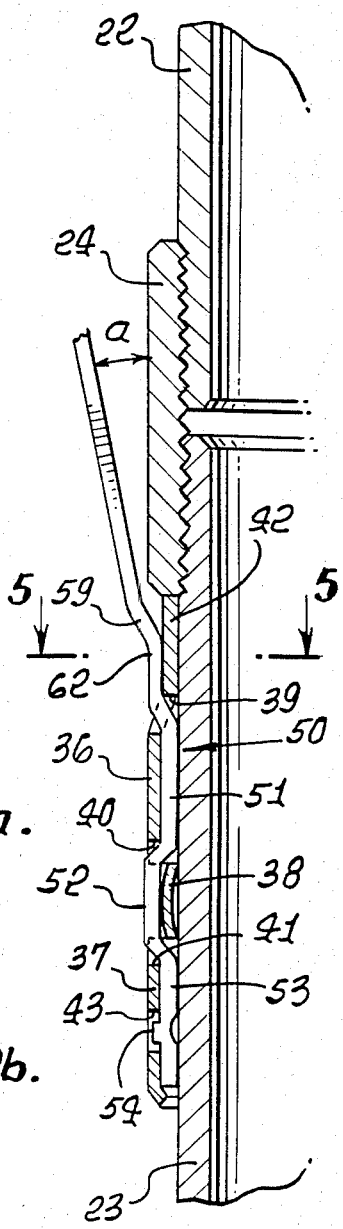
FIG. 2 is an enlarged partial sectional view taken along the line 2—2 of FIG. 1.
Figure 2A:
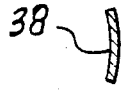
FIGS. 2*a* and 2*b* are sectional views of a portion of FIG. 2, showing alternative embodiments.
Figure 2B:
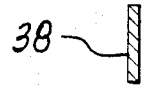
Figure 9:
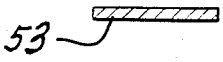
FIG. 9 is an enlarged partial sectional view taken along the line 9—9 of FIG. 1.
Figure 10:
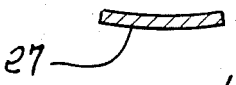
FIG. 10 is an enlarged partial sectional view taken along the line 10—10 of FIG. 1.
Figure 11:
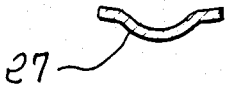
FIG. 11 is a view similar to that of FIG. 10 showing an alternative configuration.

The bows 27 typically are made of a strip of spring steel, and each bow has a collar engaging section 50 at each end, as best seen in FIGS. 2 and *7a*. The collar engaging section is a hat section with a first member 51 aligned with a second member 52, with an upstanding member 53 therebetween. Upstanding tabs 54 may be provided in the second member 52, for mating with the openings 43 in the channel 37. The collar engaging section at each end of the bow may be flat in cross-section, as shown in FIG. 9. Alternatively, this portion could be concave, as shown in FIG. 10. Similarly, the central portion of the bow may be concave as shown in FIG. 10, or dished as shown in FIG. 11, or flat as shown in FIG. 9.

Figure 7:
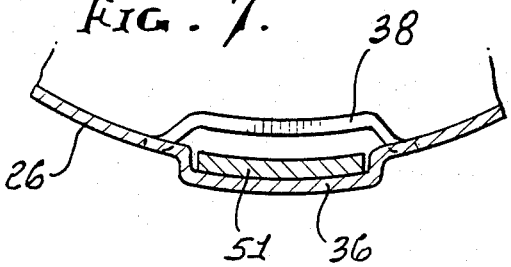
Figure 7A:
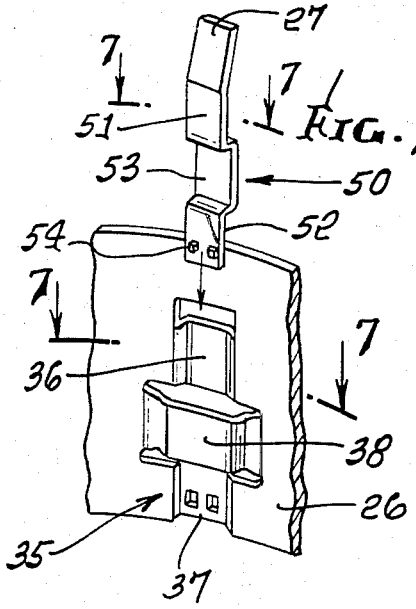

In assembly, the collar engaging section 50 of a bow 27 is slid into the passage formed by the channels of the bow receiving section 35 of the collar, as shown in FIGS. 7 and *7a*. The upstanding member 53 of the hat section of the bow is positioned in the opening between the channels 36, 37 of the collar, opposite the channel 38. The channel 38 is then compressed, as by hammering, to lock the bow in place in the collar, as shown in FIGS. 2, 8 and *8a*. The channel 38 may have various cross-section shapes for improving the locking, such as concave as shown in FIG. 2, convex as shown in FIG. *2a*, and flat as shown in FIG. *2b*. A curved configuration is preferred, as a tension load on a bow tends to increase the curvature and thereby improve the locking of the bow to the collar.

In the preferred embodiment, the bows 27 are arcuate except at the ends, as best seen in FIG. 1. However an asymetrical arcuate construction is preferred. The angle of the bow at the upper collar, shown at b, preferably is greater than the angle of the bow at the lower collar, shown at a. Preferably, the angle b is in the order of 3° to 5° greater than the angle a and by way of example, b may be 14° and a may be 10°. This desired difference may be achieved by having the radius of curvature of the bow displaced upward from the midpoint of the bow. This is shown in FIG. 1, with the bow midpoint at 56, and with the radius 57 of the curve of the bow at its widest point spaced upward from the midpoint 56 by the amount c. Also, in the embodiment illustrated in FIG. 2, at the transition between the arcuate central portion of the bow and the collar engaging section 50 at the bow end, the bow has a short section 59 of an angle greater than angle a or b of the central section.

The centralizer is ordinarily used by pushing it down in the bore hole. By having the lower angle a of the bow less than the upper angle b, the centralizer is easier to push down the hole. Where movement in both directions is involved, the off center bows may be utilized with alternative bows having the lesser angle a at the bottom and the intervening bows having the lesser angle a at the top.

The bows are compressed when the centralizer is inserted in the bore hole and normally this compressing of the bows applies an inward force to the well casing at the transition point between the central section of the bow and the ends of the bow. In the embodiment of the invention with the collars having the end sections 42, the increased loading on the casing resulting from bow compression, is avoided. This is illustrated in FIG. 2, where the section 62 of the bow rests against the section 42 of the collar, rather than having the section 62 being forced against the casing by the bow compression. With the uncompressed bow, the pressure contact between the bow and the casing tends to be in the region of the first member 50. However as the bow is compressed, this point moves away from the end of the bow toward the center, thereby providing a stiffer load, which is desirable in the centralizer. Also, increased stiffness in the bow can be obtained by prestressing the bow so that when at rest prior to assembly, the two ends of the bow do not lie in a plane but rather at a small angle with each other.

Centralizers are required to pass along casings through bore holes which have a curvature, and also function to space a casing from the wall of a bore which is curved. When in this condition, the two collars are not aligned as shown in FIG. 1, but rather one is oblique with respect to the other. This places a wide range of loadings on the interconnection between the bow ends and the collar. One advantage of the present design is the ability of the centralizer to accommodate stretching and bending of the unit without separation of the bows from the collars. There is flexibility in the bow to collar attachment, while at the same time being quite strong. The third channel 38 of the collar which is deformed to lock the bow in place is formed integral with the collar and is fully supported at both ends. At the same time, this assembly is obtained without requiring welding or the use of additional parts. The collars and bows are easily assembled by unskilled labor working under adverse conditions, and the fastening requires only compressing the channels 38, without requiring any alignment or fitting of one part into another, or the like.

I claim:

1. In a centralizer for a well casing, said centralizer comprising a plurality of bows joined at the bow ends to first and second collars, respectively, the improvement wherein:

each of said collars comprises an arcuate band with a bow receiving section for each bow, each of said bow receiving sections having first and second aligned channels formed in a first direction and a third channel formed in a second opposite direction and aligned with said first and second channels defining a bow receiving passage, with a first opening between said first and second channels in which said third channel is disposed, and with each of said channels having a central section and opposed parallel edges, with both opposite edges of each channel and the intermediate central sections formed as an integral part of said collar; and wherein each of said bows comprises an arcuate strip with a collar engaging section at each end, each of said collar engaging sections having formed therein a hat section with first and second aligned members and an upstanding third member therebetween;

with a bow end slideable into a collar passage with said bow hat section third member disposed in said collar first opening and with said bow hat section first and second members in said collar first and second channels, respectively.

2. A centralizer as defined in claim 1 with said parallel edges of said collar bow receiving section third channels deformed into said collar engaging section hat section third members.

3. A centralizer as defined in claim 2 wherein said collar bow receiving section third channel is concave as viewed in an axial collar section.

4. A centralizer as defined in claim 2 wherein said collar bow receiving section third channel is convex as viewed in an axial collar section.

5. A centralizer as defined in claim 2 wherein said collar bow receiving section third channel is flat as viewed in an axial collar section.

6. A centralizer as defined in claim 1 including a peripheral slot in said collar bow receiving section between said first channel and an end section of said collar for spacing the bow from the casing.

7. A centralizer as defined in claim 1 including peripheral slots in said collar bow receiving section between said first and second channels and said third channel, with collar first tabs at the ends of said slots bent outwards.

8. A centralizer as defined in claim 7 including spaced openings in said collar bow receiving section third channels, and mating protruding second tabs in said bow collar engaging section members.

9. A centralizer as defined in claim 1 wherein each of said collar bow receiving section first and second channels has spaced legs joined by a center, with a reinforcing rib formed in said collar at each of said legs.

10. A centralizer as defined in claim 1 with the central section of a bow between said collar engaging sections having a first angle at one end and a second larger angle at the other end.

11. A centralizer as defined in claim 10 wherein said second angle is in the range of about 3° to 5° greater than said first angle.

12. A centralizer as defined in claim 1 wherein a bow has a radius of curvature offset from the midpoint of the bow.

13. A centralizer as defined in claim 1 wherein a bow at the transition between a collar engaging end section and the bow central section has a substantially flat section at the collar end section, and an adjacent section of a greater angle than that of the bow central section.

14. a centralizer as defined in claim 1 wherein a bow central section cross-section between said collar engaging sections is concave.

15. A centralizer as defined in claim 1 wherein a bow central section cross-section between said collar engaging sections is flat.

16. A centralizer as defined in claim 1 wherein a bow central section cross-section between said collar engaging sections is dished.

17. A centralizer as defined in claim 1 wherein each of said collars comprises a plurality of arcuate segments having interengaging ends for forming a circular collar, at least one of said ends including hinge means formed by folding a collar end on itself defining an elongate loop with an open center, with the longer axis of said loop generally tangent to the collar circle, and with a tab formed as a part of said loop and projecting from a wall of said loop into said open center.

18. A centralizer as defined in claim 1 wherein each of said collars comprises a plurality of arcuate segments having interengaging ends for forming a circular collar, at least one pair of said interengaging ends including a plurality of spaced hinge means formed by folding a collar end on itself defining an elongate loop with an open center, with the longer axis of said loop generally tangent to the collar circle, and with a tab formed as a part of at least one of said loops and projecting from a wall of said loop at an oblique angle into said open center.

19. A centralizer as defined in claim 18 including a pin in said open centers of said loops and engaging said tabs.

20. In a process for producing a centralizer for a well casing, the centralizer comprising a plurality of bows joined at the bow ends to first and second collars, respectively, the steps of:

forming on each of the collars a bow receiving section for each bow, with each bow receiving section having first and second aligned channels in a first direction and a third channel in a second opposite direction and aligned with the first and second channels to define a bow receiving passage, with a first opening between the first and second channels in which said third channel is disposed, and with each of said channels having a central section and opposed parallel edges, with both opposite edges of each channel and intermediate central section formed as an integral part of said collar;

forming on each of the bows a collar engaging section at each end, with each collar engaging section having a hat section with first and second aligned members and an upstanding third member therebetween;

sliding the bow ends into the collar passages with a bow hat section third member disposed in a collar first opening and with the bow hat section first and second members in collar first and second channels, respectively; and compressing the collar third channels against the bow hat section third members and deforming the parallel edges of the third channels to lock the bow ends in the respective collars.

21. In a centralizer for a well casing, said centralizer comprising a plurality of bows joined at the bow ends to first and second collars, respectively, the improvement wherein:

each of said collars comprises an arcuate band with a bow receiving section for each bow, each of said bow receiving sections having first and second aligned channels formed in a first direction and a third channel formed in a second opposite direction and aligned with said first and second channels defining a bow receiving passage, with a first opening between said first and second channels in which said third channel is disposed; and wherein each of said bows comprises an arcuate strip with a collar engaging section at each end, each of said collar engaging sections having formed therein a hat section with first and second aligned members and an upstanding third member therebetween;

with a bow end slideable into a collar passage with said bow hat section third member disposed in said collar first opening and with said bow hat section first and second members in said collar first and second channels, respectively; and with peripheral slots in said collar bow receiving section between said first and second channels and said third channel, with collar first tabs at the ends of said slots bent outwards.

22. A centralizer as defined in claim 21 including spaced openings in said collar bow receiving section third channels, and mating protruding second tabs in said bow collar engaging section members.

23. In a centralizer for a well casing, said centralizer comprising a plurality of bows joined at the bow ends to first and second collars, respectively, the improvement wherein:

each of said collars comprises an arcuate band with a bow receiving section for each bow, each of said bow receiving sections having first and second aligned channels formed in a first direction and a third channel formed in a second opposite direction and aligned with said first and second channels defining a bow receiving passage, with a first opening between said first and second channels in which said third channel is disposed; and wherein each of said bows comprises an arcuate strip with a collar engaging section at each end, each of said collar engaging sections having formed therein a hat section with first and second aligned members and an upstanding third member therebetween;

with a bow end slideable into a collar passage with said bow hat section third member disposed in said collar first opening and with said bow hat section first and second members in said collar first and second channels, respectively; and with each of said collar bow receiving section first and second channels having spaced legs joined by a center, with a reinforcing rib formed in said collar at each of said legs.

24. In a centralizer for a well casing, said centralizer comprising a plurality of bows joined at the bow ends to first and second collars, respectively, the improvement wherein:

each of said collars comprises an arcuate band with a bow receiving section for each bow, each of said bow receiving sections having first and second aligned channels formed in a first direction and a third channel formed in a second opposite direction and aligned with said first and second channels defining a bow receiving passage, with a first opening between said first and second channels in which said third channel is disposed; and wherein each of said bows comprises an arcuate strip with a collar engaging section at each end, each of said collar engaging sections having formed therein a hat section with first and second aligned members and an upstanding third member therebetween;

with a bow end slideable into a collar passage with said bow hat section third member disposed in said collar first opening and with said bow hat section first and second members in said collar first and second channels, respectively, and with each of said collars comprising a plurality of arcuate segments having interengaging ends for forming a circular collar, at least one pair of said interengaging ends including a plurality of spaced hinge means formed by folding a collar end on itself defining an elongate loop with an open center, with the longer axis of said loop generally tangent to the collar circle, and with a tab formed on each said loop and projecting at an oblique angle into said open center; and including a pin in said open centers of said loops and engaging said tabs.

* * * * *